US006314772B1

(12) United States Patent
Hohlfelder

(10) Patent No.: US 6,314,772 B1
(45) Date of Patent: Nov. 13, 2001

(54) LOCK MECHANISM FOR PULL STATION

(75) Inventor: Eric W. Hohlfelder, Madison, CT (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/374,728

(22) Filed: Aug. 13, 1999

(51) Int. Cl.[7] ..... B65D 55/14

(52) U.S. Cl. ..... 70/161; 70/162; 70/492; 70/DIG. 30; 70/DIG. 49

(58) Field of Search ..... 70/159–162, 492, 70/DIG. 30, DIG. 49; 200/50.03, 50.19

(56) References Cited

U.S. PATENT DOCUMENTS 1,280,633 * 10/1918 Baird ..... 70/492
1,298,224 * 3/1919 King ..... 70/492

(List continued on next page.)

FOREIGN PATENT DOCUMENTS

115446 * 11/1945 (SE) ..... 70/492

OTHER PUBLICATIONS

Notifier brochure, "NBG–10 Series Non–Coded Manual Fire Alarm Station," 1995 (2 pages).
Notifier brochure, BGX–101L "Addressable Manual Pull Station," 1995 (2 pages).
Three photographs (front, inside, rear) of Notifier Model BGX–101L Non–Coded Fire Alarm Box.
Notifier brochure, "BNG & BRG Series Manual Fire alarm Stations," 1995 (2 pages).
Notifier brochure, "LNG Double–Action Manual Fire Alarm Station," 1994 (2 pages).
Two photographs (front and rear) of Notifier Model LNG–1 R Pull Box.
Notifier brochure, "Manual Alarm Station Wiring, Product Installation Document" (1 page).
Signal Communications Corporation Advertisement, "You're in good company with SigCom." 1996 (1 page).
Federal Signal Corporation brochure, "MMPS–Modular Manual Pull System" (2 pages).
Federal Signal Corporation brochure, "Modular Manual Pull System Model MMPS", 1997 (4 pages).
Federal Signal Corporation brochure, "Modular Manual Pull System Model MMPS", 1996 (2 pages).
Federal Signal Corporation brochure, "Installation Instructions For Model MMPS Pull Stations" (2 pages).

(List continued on next page.)

*Primary Examiner*—Lloyd A. Gall
(74) *Attorney, Agent, or Firm*—Rockey, Milnamow & Katz, Ltd.

(57) ABSTRACT

A lock for locking closed a housing for an alarm pull station includes a lock cam and a lock cylinder assembly. The lock cylinder assembly includes: a lock actuation cylinder having a keyhole exposed on a front side of the housing and a key actuation socket in registry with the keyhole, and a tumbler plate movable transversely through the lock actuation cylinder and interposed between the keyhole and the socket. The tumbler plate includes a bore which is out of registry with the keyhole and movable into registry with the keyhole by a key pushed into the keyhole. The lock actuation cylinder is rotatable by an Allen wrench key fit into the socket. The lock actuation cylinder is surrounded by a lock body which is fixed to the housing. The tumbler plate is biased to be engaged into a slot in the lock body and is moveable transversely by the key to disengage the lock body. The lock actuation cylinder rotates the lock cam for locking the base plate to the cover. The lock cylinder assembly allows opening of the housing using a commonly available Allen wrench but prevents visual inspection of the key socket, through the keyhole, to ascertain the correct size key.

14 Claims, 5 Drawing Sheets

U.S. PATENT DOCUMENTS

| | | | | |
|---|---|---|---|---|
| 1,789,757 | * | 1/1931 | Jacobi | 70/492 |
| 2,025,293 | * | 12/1935 | Nawn | 70/492 |
| 2,093,925 | * | 9/1937 | Pickop | 70/493 |
| 2,356,989 | * | 8/1944 | Getz et al. | 70/422 X |
| 2,830,143 | | 4/1958 | Koopman | 200/44 |
| 3,656,328 | * | 4/1972 | Hughes | 70/403 X |
| 4,075,879 | * | 2/1978 | Christopher | 70/492 X |
| 4,554,808 | * | 11/1985 | Escaravage | 70/DIG. 30 X |
| 5,172,097 | * | 12/1992 | Arnold | 70/DIG. 49 X |
| 5,251,467 | | 10/1993 | Anderson | 70/370 |
| 5,893,284 | * | 4/1999 | Hrabal | 70/375 X |
| 5,927,111 | * | 7/1999 | Nachbauer | 70/161 |

OTHER PUBLICATIONS

ADI catalogue, "Accessories/Pull Stations" (1 page).

General Signal/Edwards brochure, "Non–Coded Fire Alarm Stations" 1990 (10 pages).

Thorn brochure, "Manual Alarm Stations" (2 pages).

Aames Security Corporation brochure, "Manual Stations" (2 pages).

ESL Sentrol Catalog, "103 Series Manual Fire Alarm Stations" (1 page).

Harrington brochure, "HSPS Series Explosion Proof Manual Pull Stations" (4 pages).

Harrington brochure, "FA50 Series Non–Coded Manual Pull Stations" (2 pages).

Harrington brochure, "FA60 Manual Non–Coded Stations" (2 pages).

Harrington brochure, "Manual Fire Alarm Stations Weatherproof" (2 pages).

Cerberus Pyrotronics brochure, "MS–151 and MS–157 Manual Fire Alarm Station" 1993 (2 pages).

Cerberus Pyrotronics brochure, "Intelligent Initiating Devices Manual Station" (3 pages).

Gamewell brochure, "IdentiFlex 600 Series Addressable Manual Station (MS–95)" 1994 (2 pages).

Signal Communications Corporation brochure, "Fire Alarm Systems Accessories" 1996 (4 pages).

Fire Control Instruments brochure, "MS–2 Series Non–Coded Double Action Manual Fire Alarm Station" (2 pages).

Fire Control Instruments brochure, "MS–6 Non–Coded Manual Fire Alarm Station" (2 pages).

Fire Control Instruments brochure, "MS–WS Series Weatherproof Manual Fire Alarm Station" (1 page).

* cited by examiner

LOCK MECHANISM FOR PULL STATION

TECHNICAL FIELD OF THE INVENTION

The present invention relates to lock mechanisms. Particularly, the invention relates to lock mechanisms for emergency pull stations, such as pull stations for triggering fire alarms.

BACKGROUND OF THE INVENTION

In known fire alarm pull stations, a lever is provided which can be manually pivoted or depressed to set off a local or centralized fire alarm. Such fire alarms are typically present in buildings such as schools, hospitals, and the like The alarm pull stations mount on a wall and are typically color coded to be easily recognizable in an emergency.

Such pull stations are manufactured for example by Pittway Corpration, NOTIFIER division, such as model NBG-10 series Non-Coded Manual Fire Alarm Station, BGX-101L Addressable Manual Pull Station, BNG and BRG series Manual Fire Alarm Stations or LNG Double-Action Manual Fire Alarm Station.

To prevent vandalism or nuisance alarms involving such pull stations, the pull stations are configured to lock in place once the activation lever is depressed or otherwise placed in an alarm state. To reset a pull station, a key is required to release the lever to its initial, non-alarm state. Typically the pull station key is entrusted to a person of authority for a building, for example, or with fire department personnel.

Given long periods of time between alarm actuations, keys can become lost. Also, the person holding the key may be unavailable to reset the pull station.

There continues to be a need for lock mechanisms which, while secure, can be unlocked by a large group of people. Preferably such expanded capability could be provided at substantially the same cost as present locks and without requiring added space in the respective unit being secured.

SUMMARY OF THE INVENTION

According to a first aspect of the invention, a lock mechanism includes a lock cylinder assembly which can be actuated by a preselected shaped key inserted into a correspondingly shaped key-receiving actuation socket, but which otherwise conceals the key-receiving actuation socket from view to prevent the unauthorized actuation of the lock mechanism. The invention is particularly useful when the key is a common tool, such as an Allen wrench. The lock mechanism is particularly useful in preserving any condition, or state of a device by preventing the unauthorized change or resetting of such condition or state, where such condition or state is intended to be changed or reset by an authorized person having possession of a key to the lock mechanism. The lock mechanism is particularly useful in preserving the locked security of housings for electrical devices, such as a housing for a pull station for an alarm system.

According to the invention, the lock mechanism includes an improved lock cylinder assembly. The lock cylinder assembly includes a lock actuation cylinder having a circular keyhole at one end thereof in registry with a hexagonal key actuation socket recessed deeper into the lock actuation cylinder. The actuation socket is shaped to receive a standard Allen wrench of a predetermined size as the "key".

A single, interposed, spring-loaded tumbler plate penetrates the lock actuation cylinder so as to be interposed between the keyhole and the key actuation socket. The tumbler plate has an intermediate bore which is biased by a spring to be out of registry with the keyhole. During key actuated locking or unlocking, the tumbler is forcibly moved transversely to register the intermediate bore with the keyhole by insertion of the Allen wrench key. The key, if properly selected, will fit into the key actuation socket.

The lock actuation cylinder can be connected to a lock cam. Turning of the lock actuation cylinder causes the lock cam to engage external structure.

The lock cylinder assembly also includes a lock body which surrounds the actuation cylinder. A retaining ring secures the lock body to surrounding structure such as to a cover, wall or door to be locked.

The lock body includes at least one groove adjacent to the tumbler plate. The tumbler plate is biased to have a head portion thereof extending into the groove of the lock body in the absence of a key. This coaction prevents relative rotation of the lock actuation cylinder and the lock body. When a key is substantially completely inserted into the lock actuation cylinder, the tumbler plate is transversely moved such that the head portion thereof is retracted from the groove of the lock body to allow relative rotation between the lock actuation cylinder and the lock body.

The tumbler plate acts as a barrier to cover the observable shape of the key actuation socket to prevent the unauthorized opening by a person having access to Allen wrenches, given unrestricted visual observation of the size and shape of the key actuation socket by looking through the keyhole. With no key in the keyhole, the intermediate bore of the tumbler plate is sufficiently out of registry, either partially or totally, to prevent ascertainment of the correct shape needed to fit the key actuation socket. A variety of keys such as hexagonal or spline wrenches could be used.

According to another aspect of the invention, a pull station is secured by the aforementioned lock mechanism. The pull station includes a back plate or base plate which carries an alarm switch and a terminal block wired thereto.

A cover is hingedly connected to the back plate. The cover carries a pull handle slidably coupled thereto and accessible through an opening in a front wall of the cover.

The lock mechanism of the invention is installed in an opening in the front wall of the cover. When locked, the lock mechanism prevents the resetting of the pull station. Locking the cover to the back wall forms a closed configuration and prevents access behind the cover to reset the pull station.

The back plate includes a stepped surface extending forwardly thereof and in registration with a latch. As the handle is being slid, with respect to the cover and back plate, to activate the station, the latch slides on the stepped surface. In response to force from a spring, the latch extends behind a perpendicular surface of the stepped surface. The perpendicular surface prohibits the latch from moving in a reverse direction. This in turn prohibits the handle from being slid in a reverse direction.

In order to reset the handle to its initial, inactive position, the cover must be unlocked and opened. The latch can be released and the handle retracted. The cover can then be closed to the base plate and re-locked.

Thus, the lock mechanism of the present invention provides security against unauthorized opening and/or resetting of the pull station while at the same time allowing for a common tool to open and/or reset the pull station. The need to retain specially cut keys, and to find such keys when needed, is obviated.

Numerous other advantages and features of the present invention will become readily apparent from the following detailed description of the invention and the embodiments thereof, from the claims and from the accompanying drawings in which details of the invention are fully and completely disclosed as part of this specification.

DETAILED DESCRIPTION OF THE PREFERRED EMBODIMENTS

Figure 1:
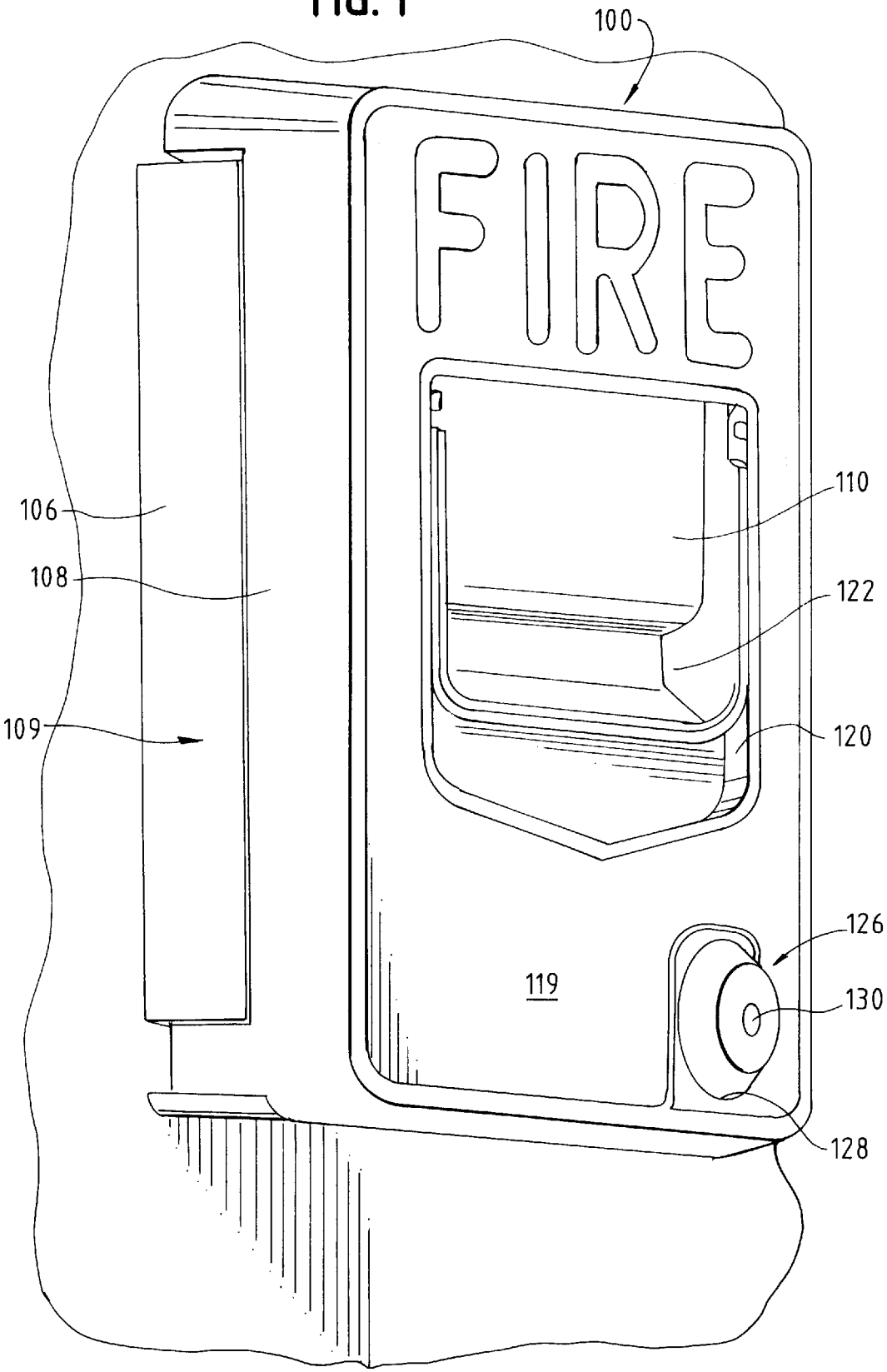
FIG. 1 is a perspective view of an assembled pull station of the present invention.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a pull station 100. An exemplary embodiment of a pull station can be found in U.S. Ser. No. 09/373,867, filed Aug. 13, 1999, Attorney docket number FLP 110.0, entitled "Pull Station", filed on the same day as the present application, and herein incorporated by reference.

The pull station includes a base plate 106, a cover 108 which together form a housing 109, and a pull handle 110 arranged between the base plate 106 and the cover 108. The cover 108 is hinged to the base plate by a hinge assembly 111. The cover 108 includes a front wall 119 having a window 120 which exposes a gripping portion 122 of the handle to allow manual movement of the handle within the housing 109.

A lock cylinder assembly 126 is carried by the front wall 119, exposed through an aperture 128 through the front wall 119. The lock cylinder assembly includes a keyhole 130 for receiving a key or a tool to lock or unlock the free edge 108*a* of the hinged cover 108 to/from the base plate 106.

Figure 2:
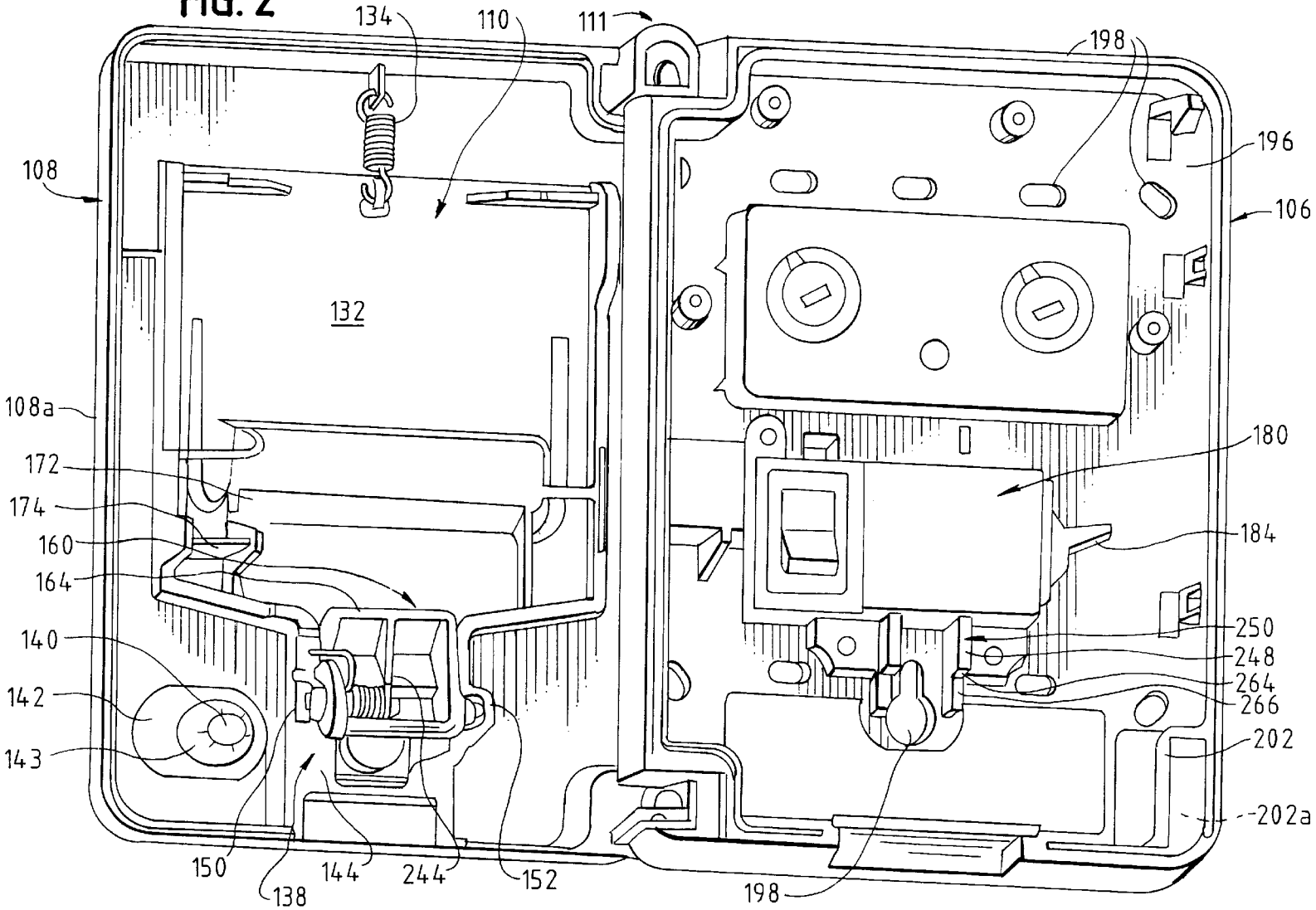
FIG. 2 is a elevational view of the pull station of FIG. 1 with the cover completely opened.
Figure 3:
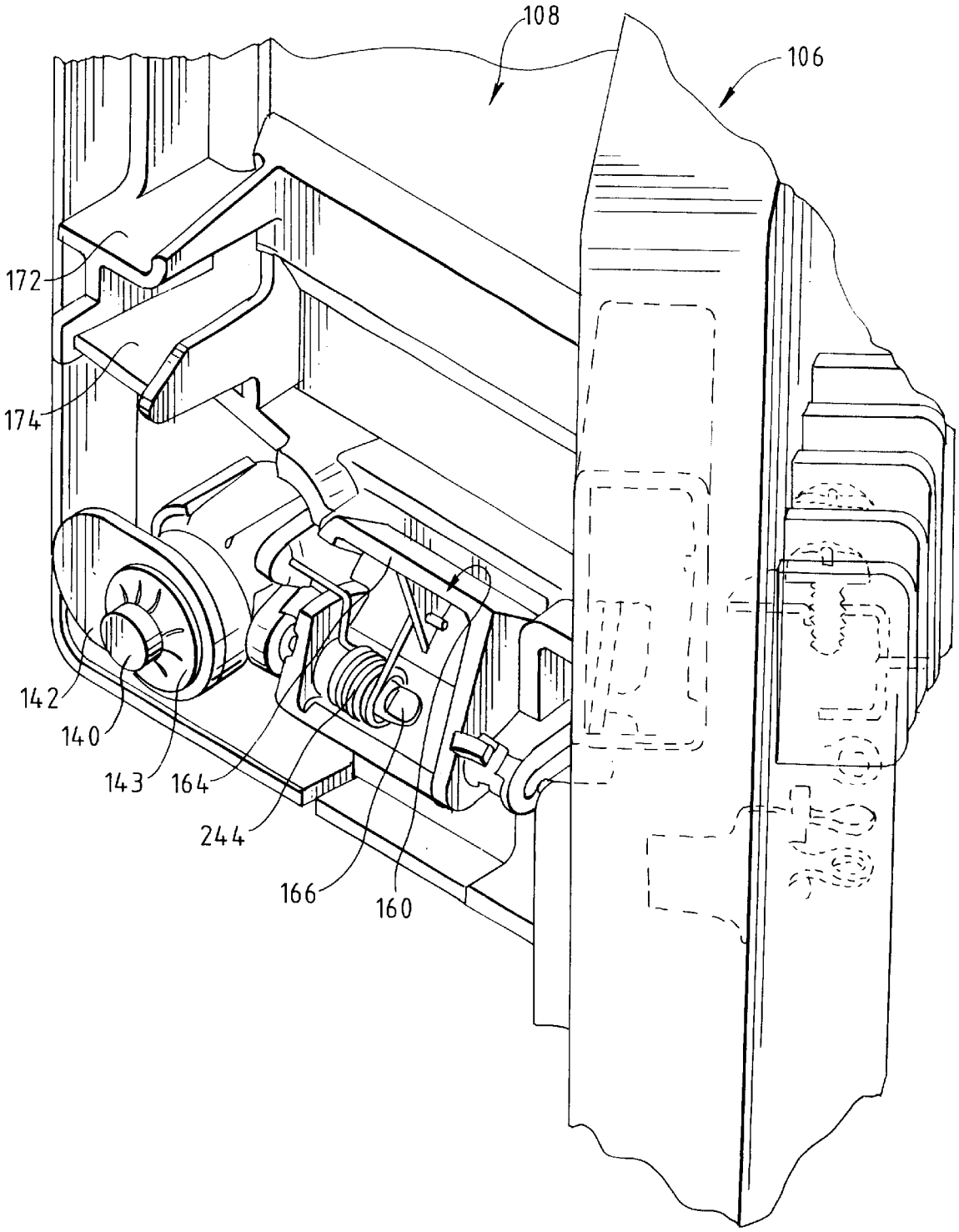
FIG. 3 is an enlarged fragmentary perspective view of the pull station of FIG. 1, with the cover partially open.

FIGS. 2 and 3 illustrate the housing 109 in an open configuration. The base plate 106 includes a back wall 196 having openings 198 for attaching the pull station 100 to an electrical box, a wall surface, or other structure. The handle 110 includes a body portion 132 which is biased by a spring 134 to an elevated position on the cover 108. The handle 110 also includes an extension portion 138 connected to the body portion 132. The lock cylinder assembly 126 includes a rotatable output shaft 140 fixed for rotation with a lock cam 142 which is retained on the shaft by a friction lock washer 143.

The body portion 132 of the handle 110 includes a switch activating wall 172 and a switch deactivating wall 174. The base plate 106 includes a covered switch element 180 activated and deactivated by a switch lever 184. The switch lever is moved to activate or deactivate by the walls 172, 174 respectively.

The extension portion 138 further includes side walls 150, 152 extending from the front wall portion 144 in a substantially perpendicular direction. A latch mechanism 160 is located between the side walls 150, 152 and is journalled for rotation at each side wall 150, 152. The latch mechanism or "trigger", includes a latch element 164 at one end and an axle 166 at another end. The axle is arranged between the journals of the side walls 150, 152.

When the cover 108 is closed to the base plate 106, a torsion spring 244 biases the latch member to rotate about axle 166 in a direction wherein the element 164 rotates toward the base plate 106. The latch element 164 presses on an upper surface 248 of a stepped wall 250 formed on the base plate 106.

When the handle is slid downwardly, the latch slides on the surface 248. The latch element 164 drops below the upper surface 248 to underlie a perpendicular surface 264. The latch can then be rotated by force from the torsion spring 244. The latch element 164 fully rotates to a position resting on a lower surface 266 of the base plate 106. The handle is now fully locked in its depressed position. To reset the pull station, the latch must be released and the handle raised which requires unlocking the lock cylinder assembly 126 and opening the cover 108 from the base plate 106.

A corner wall 202 is arranged to be captured by the lock cam 142 to keep the cover 108 locked to the base plate 106. The lock cam 142 is rotated to abut a backside surface 202*a* of the corner wall 202.

Figure 4:
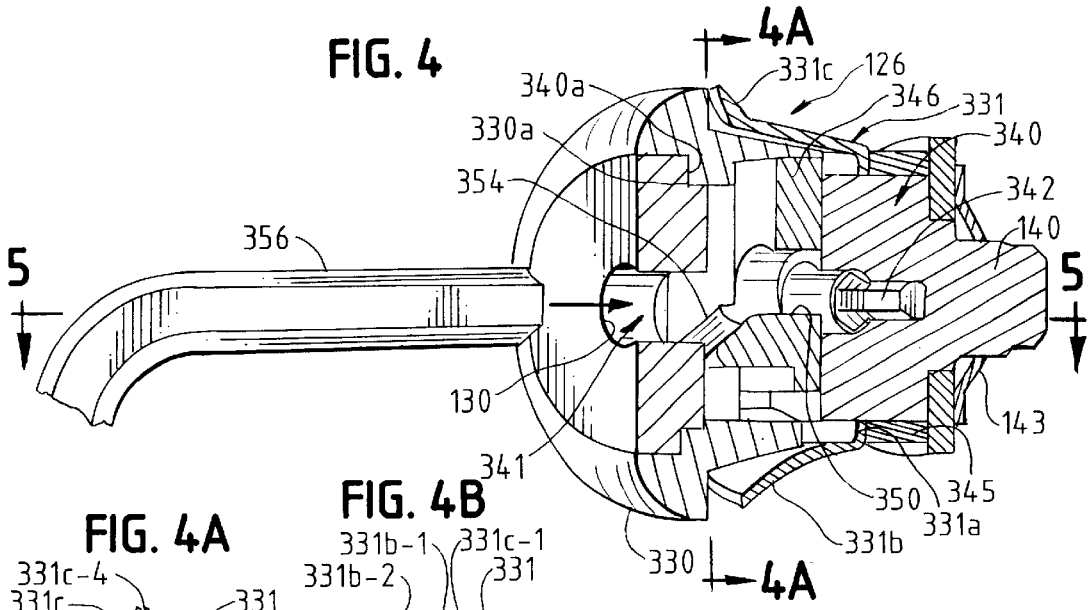
FIG. 4 is a perspective sectional view of a lock mechanism of the present invention.

FIG. 4 illustrates the lock cylinder assembly 126 which includes a lock body 330 and a retaining ring 331. The retaining ring 331 can be of a type described in U.S. Pat. No. 5,251,467, herein incorporated by reference. The retaining ring 331 includes a base ring portion 331*a* and two depending prongs 331*b*, 331*c*. The retainer base ring portion 331*a* surrounds the actuation cylinder 340 with the prongs 331*b*, 331*c* extended therefrom towards the front wall. The lock body 330 and the retaining ring prongs 331*b*, 331*c* capture the front wall 119 to mount the lock to the cover 108.

Figure 4A:
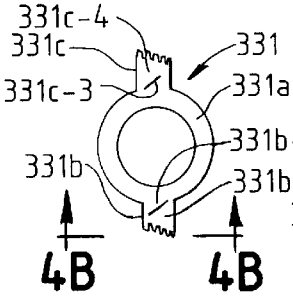
FIG. 4A is an elevational view of a retaining ring taken generally along line 4A—4A of FIG. 4.
Figure 4B:
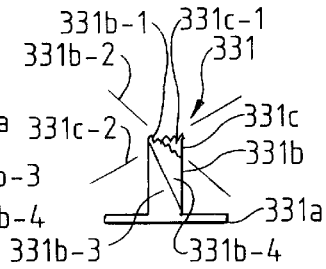
FIG. 4B is a bottom view of the retaining ring taken along line 4B—4B of FIG. 4A.

As shown in FIGS. 4A and 4B, the prongs 331*b*, 331*c* have inclined, sawtooth edges 331*b*-1, 33*1c*-1 which prevent the removal of the lock body from outside the front wall 119 by effectively "biting" into the material of a back side of the front wall 119. The edges are arranged along inclined lines 331*b*-2, 331*c*-2 respectively. Each prong 331*b*, 331*c* includes a bend line 331*b*-3, 331*c*-3 and a contiguous triangular portion 331*b*-4, 331*c*-4, which includes the respective sawtooth edge, bent outwardly from the base ring portion 331*a*. The lock body fits into the aperture 128. The aperture 128 can be a "double-d" type hole which is an elongated hole with straight sides and rounded ends (typically 0.76" long and 0.640" wide). The shape of the hole prevents the body from rotation once installed.

The lock body 330 contains therein a lock actuation cylinder 340. The actuation cylinder 340 is installed into the lock body 330 from a front side thereof until an annular shoulder 340*a* of the actuation cylinder 340 abuts an annular step 330*a* within the lock body 330. The actuation cylinder includes a key-receiving bore 341 extending between the round keyhole 130 and a hexagonal key actuation socket 342 for receiving an Allen-type wrench 356. The keyhole 130 and the key actuation socket 342 are in registry.

The lock actuation cylinder 340 is connected via the output shaft 140 to the lock cam 142. The shaft 140 has a square cross sectional region 140*a*. The lock cam 142 includes a square aperture 142*a* which snugly receives the square cross sectional region 140*a*. Thus the shaft 140 and the lock cam are configured to rotate together. Other means of causing conjoint rotation of the shaft 140 and the lock cam 142 are encompassed by the invention.

A spacer ring 345 is arranged around the actuation cylinder 340 against the retaining ring base ring portion 331*a*. The lock cam 142 is captured between the spacer ring 345 and the frustoconical, slotted, friction washer 143. The friction washer 143 retains the lock cam 142 on the shaft 140. Other suitable means to retaining the lock bolt onto the shaft are encompassed by the invention. The spacer ring can be composed of a resilient material such as plastic and can provide a slide bearing surface 345*a* against which the lock bolt can rotate.

A tumbler plate 346 is arranged through a slot or bore 347 of the actuation cylinder 340 located between the keyhole 130 and the hexagonal key actuation socket 342. The centered, circular keyhole 130 extends partially in registry with an intermediate bore 350 through the tumbler plate 346.

Figure 5:
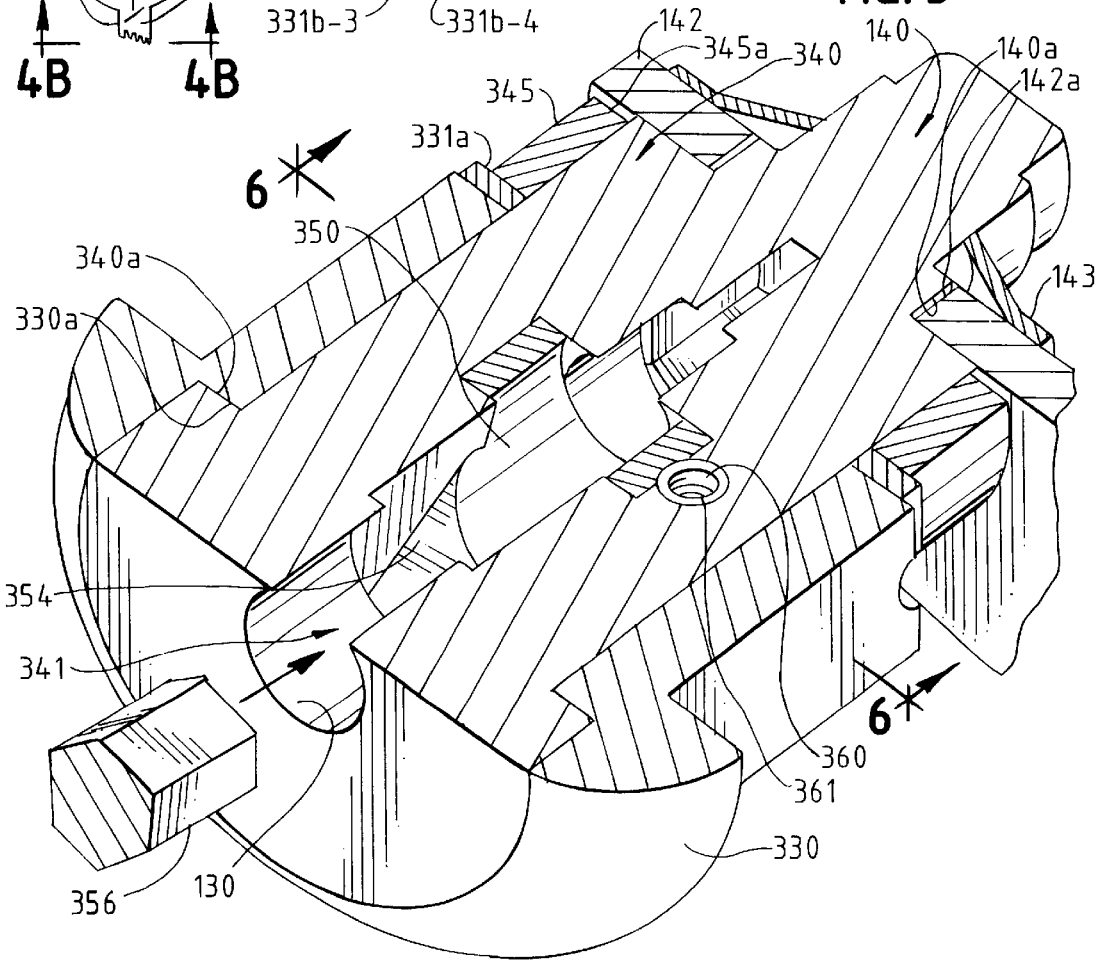
FIG. 5 view taken generally along line 5—5 of FIG. 4.

As indicated in FIGS. 4 and 5, adjacent to the bore 350, the tumbler plate 346 includes an inclined surface or ramp 354. The bore 350 is at least partially out of registry with the key actuation socket 342. The tumbler plate 346 is movable laterally (radially) by a sliding force exerted on the ramp 354 to align the keyhole 130 with the bore 350 with the key actuation socket 342. During alignment, a key, for example an Allen wrench, 356 is inserted from the keyhole 130, through the bore 350, and into the key actuation socket 342 to be able to turn the cylinder 340 by turning the Allen wrench.

It is an important advantage of the lock 126 that merely displacing the tumbler plate 346 does not make it possible to rotate cylinder 340. The key must engage the socket 342. It is the engagement of the key with the socket that then makes possible the rotation of the cylinder.

Another advantage of the lock 126 lies in the fact that the tumbler plate 346 extends into key-receiving bore 350 and blocks a direct view of the socket 342 thereby hiding the shape of same to enhance security of the lock. If an intruder inserts a screwdriver, other tool or the like into the bore 350, the tumbler plate 346 may be displaced. However, the insertion item will block any attempt to visually examine the shape of socket 342 to defeat the lock. Even if the inserted item does displace the tumbler place sufficiently, absent engagement with the surfaces of socket 342 cylinder 340 will not be rotatable.

Figure 6:
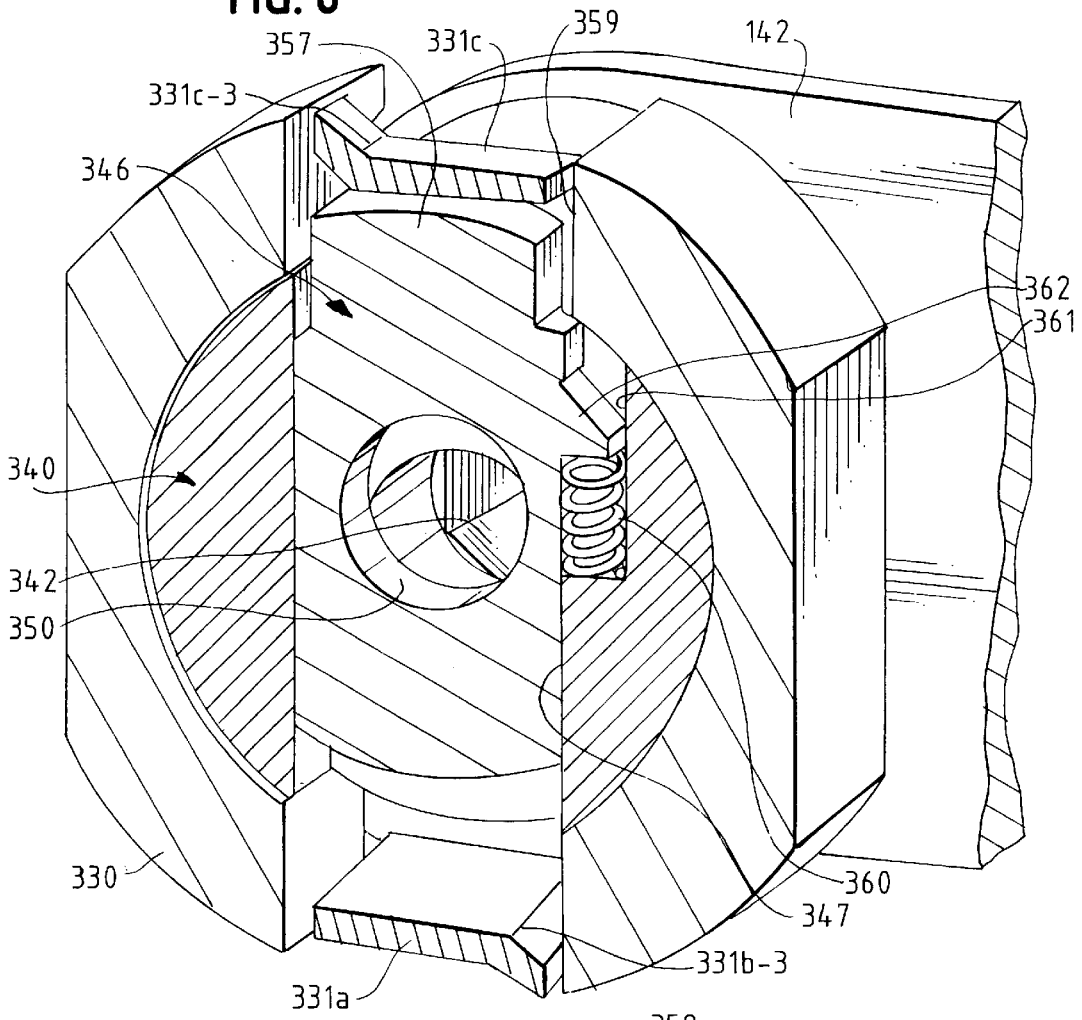
FIG. 6 is a sectional view taken generally along line 6—6 of FIG. 5.

As illustrated in FIG. 6, the tumbler plate 346 is spring biased by a coil spring 360, wherein the spring 360 exerts a vertical (radial) force on a side lug 362 of the tumbler plate 346.

The coil spring 360 is contained in a bore 361 of the actuation cylinder 340. The tumbler plate 346 is biased, as shown in FIG. 5, to have the bore 350 forced out of registry with the keyhole 130 and the key actuation socket 342.

The tumbler plate 346 also includes a head portion 357 which is shown captured within a groove 359 in the lock body 330. This coaction prevents relative rotation between the actuation cylinder 340 and the lock body 330, and hence between the actuation cylinder 340 and the front wall 119, since the lock body 330 is secured to the front wall 119.

Figure 7:
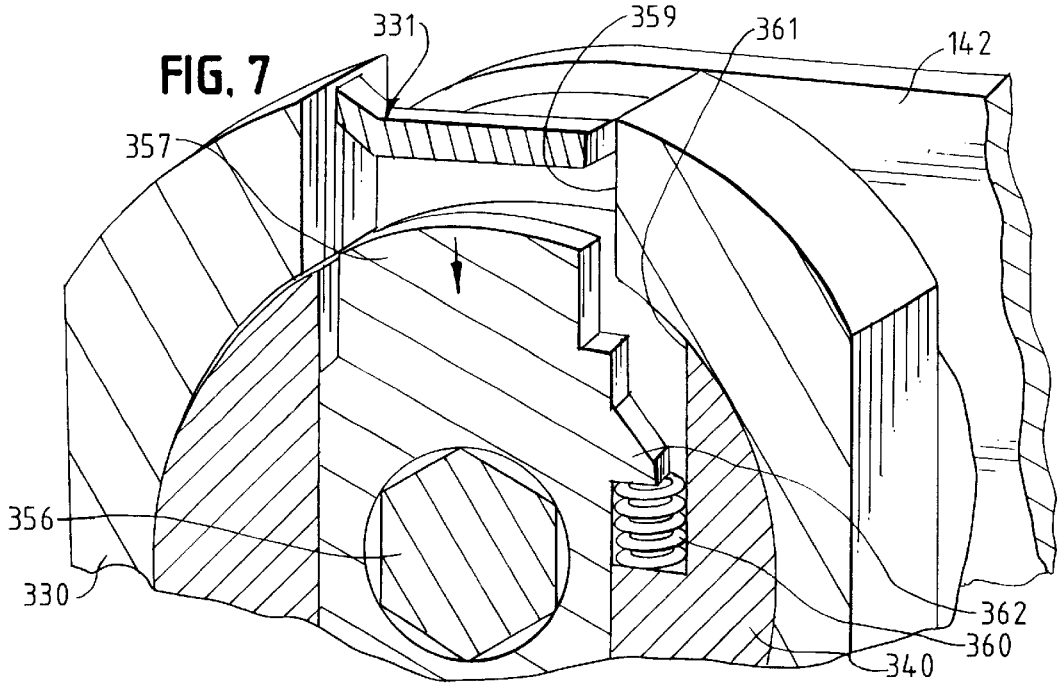
FIG. 7 is a sectional view similar to FIG. 6 but with the key inserted.

As illustrated in FIG. 7, force imparted by the Allen wrench on the ramp 354 has depressed the tumbler plate to force the Allen wrench into a position to engage the key actuation socket 342, given the proper selection of size of the Allen wrench. The spring 360 is compressed by movement of the tumbler plate 346 by force from the Allen wrench 356. The head portion 357 of the tumbler plate 346 is now clear of the groove 359 of the lock body 330 so that the actuation cylinder 340 can relatively rotate with respect to the lock body 330.

One of the advantages of the lock cylinder assembly design is the fact that a properly selected, but relatively commonly available, Allen wrench can be used to open the pull station 100. However, due to the confinement of the keyhole 130, and the interference of the tumbler plate 346, visual inspection by an unauthorized person through the keyhole 130 to determine the required Allen wrench size is very difficult.

It will also be understood that a variety of key cross sections and socket configurations can be used without departing from the spirit and scope of the present invention. A spine wrench in combination with an appropriately shaped socket could be used. Another type of key could have a somewhat circular cross section with one or more flats. A matching socket would be needed.

The present lock can be used to provide security for a variety of housings or containers without departing from the spirit or scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course intended to cover by the appended claims all such modifications as fall within the scope of the claims.

The invention claimed is:

1. A pull station for an alarm, comprising:

a housing including a base plate and a cover overlying said base plate;

a handle mounted for movement with respect to said housing;

an alarm switch within said housing which is activated by movement of said handle to place the pull station in an alarm mode;

a latch activated by movement of said handle to move to a latched position to prevent reverse movement of said handle;

a lock carried by said cover and arranged to lock said cover to said base plate, wherein said lock comprises a lock cam and a lock cylinder assembly, the lock cylinder assembly having a lock actuation cylinder having a keyhole at one end thereof and a key actuation socket in registry with said keyhole, said lock actuation cylinder rotatable by a key having a polygonal cross section fit into said socket, said lock actuation cylinder fixed for rotation with said lock cam for locking said base plate to said cover; and a tumbler plate movable with respect to said lock actuation cylinder and interposed between said keyhole and said key actuation socket, and having a bore which is out of registry with said keyhole and movable into registry by a key pushed into said keyhole.

2. The pull station according to claim 1, wherein said alarm switch has an extending alarm switch lever, said alarm switch mounted to said housing, and said handle includes a wall portion arranged to move said alarm switch lever to an alarm condition during sliding movement of said handle.

3. The pull station according to claim 1, wherein said base plate comprises a stepped surface facing said latch, said latch sliding on said stepped surface during movement of said handle, said latch underlying said stepped surface to prevent rearward retraction of said handle.

4. The pull station according to claim 1, wherein said key actuation socket is shaped to receive a key in the form of a hexagonal cross section Allen wrench.

5. The pull station according to claim 1, comprising a tumbler spring arranged between said lock actuation cylinder and said tumbler plate, wherein said tumbler plate is spring biased out of registry with said keyhole and said key socket by said tumbler spring.

6. The pull station according to claim 1, wherein said tumbler plate is movable in a transverse direction to the direction of insertion of said key, and said tumbler plate comprises an inclined surface facing said keyhole and arranged to be contacted by said key during insertion thereof into the keyhole, force imparted by said key against said inclined surface moving said tumbler plate in the transverse direction to register the keyhole with the bore of the tumbler plate.

7. The pull station according to claim 1, comprising a tumbler spring arranged between said lock actuation cylinder and said tumbler plate, wherein said tumbler plate is spring biased out of registry with said keyhole and said key socket by said tumbler spring, and wherein said tumbler plate includes a side lug, and said spring is a coil spring arranged to be compressed between said side lug and said lock actuation cylinder during transverse movement of said tumbler plate.

8. A pull station for an alarm, comprising:

a housing including a base plate and a cover overlying said base plate and hinged thereto, the cover having a hinged edge and a free edge;

a handle mounted for sliding movement within said housing, said housing having an opening for a user to exert force on said handle;

an alarm switch which is activated by sliding movement of said handle to place the pull station in an alarm mode;

a latch rotatably mounted to said handle and spring biased to rotate to a latched position upon sliding movement of said handle, said latch having a portion which moves behind a stationary element of said housing to establish the latched position;

a lock carried by the cover and arranged to lock said free edge of the cover to said base plate, wherein said lock comprises a lock cam and a lock cylinder assembly, said lock cylinder assembly having a lock actuation cylinder having a keyhole at one end thereof and a key actuation socket in registry with said keyhole, said lock actuation cylinder rotatable by a key having a polygonal cross section fit into said socket, said lock actuation cylinder connected to said lock cam to rotate said lock cam to engage a portion of said base plate, to lock said free edge of said cover to said base plate; and a tumbler plate movable with respect to said lock actuation cylinder and interposed between said keyhole and said key actuation socket, and having a bore which is out of registry with said keyhole and movable into registry by a key pushed into said keyhole, said lock actuation cylinder connected to said lock cam to rotate said lock cam to engage a portion of said base plate, to lock said free edge of said cover to said base plate.

9. The pull station according to claim 8, wherein said alarm switch has an extending alarm switch lever, said alarm switch mounted to said housing, and said handle includes a wall portion arranged to move said alarm switch lever to an alarm condition during sliding movement of said handle.

10. The pull station according to claim 8, wherein said base plate comprises a stepped surface facing a latch element of said latch, said latch element sliding on said stepped surface during sliding movement of said handle, said latch element underlying said stepped surface to prevent rearward retraction of said handle.

11. The pull station according to claim 8, wherein said key actuation socket is shaped to receive a key in the form of a hexagonal cross section Allen wrench.

12. The pull station according to claim 8, comprising a tumbler spring arranged between said lock actuation cylinder and said tumbler plate, wherein said tumbler plate is spring biased out of registry with said keyhole and said key socket by said tumbler spring.

13. The pull station according to claim 8, wherein said tumbler plate is movable in a transverse direction to the direction of insertion of said key, and said tumbler plate comprises an inclined surface facing said keyhole and arranged to be contacted by said key during insertion thereof into the keyhole, force imparted by said key against said inclined surface moving said tumbler plate in the transverse direction to register the keyhole with the bore of the tumbler plate.

14. The pull station according to claim 8, comprising a tumbler spring arranged between said lock actuation cylinder and said tumbler plate, wherein said tumbler plate is spring biased out of registry with said keyhole and said key socket by said tumbler spring, and wherein said tumbler plate includes a side lug, and said spring is a coil spring arranged to be compressed between said side lug and said lock actuation cylinder during transverse movement of said tumbler plate.

* * * * *

UNITED STATES PATENT AND TRADEMARK OFFICE

CERTIFICATE OF CORRECTION

PATENT NO. : 6,314,772 B1
DATED : November 13, 2001
INVENTOR(S) : Eric W. Hohlfelder It is certified that error appears in the above-identified patent and that said Letters Patent is hereby corrected as shown below:

Column 1,
Line 15, please delete "division," and insert -- Division, --

Column 3,
Line 18, after "5", first occurrence, please insert -- is a sectional --.

Signed and Sealed this

Sixteenth Day of April, 2002

*Attest:*

*Attesting Officer*

JAMES E. ROGAN
*Director of the United States Patent and Trademark Office*